US009652929B2

(12) United States Patent
Cornell

(10) Patent No.: US 9,652,929 B2
(45) Date of Patent: May 16, 2017

(54) GAMING MACHINE HAVING MULTI-CONFIGURATION SIDE PANELS FOR VARIABLE WAGERING-GAME ENVIRONMENTS

(71) Applicant: WMS Gaming Inc., Waukegan, IL (US)

(72) Inventor: Bradley D. Cornell, LaGrange, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 202 days.

(21) Appl. No.: 14/663,317

(22) Filed: Mar. 19, 2015

(65) Prior Publication Data

US 2015/0269808 A1 Sep. 24, 2015

Related U.S. Application Data

(60) Provisional application No. 61/968,354, filed on Mar. 20, 2014.

(51) Int. Cl.
*A63F 9/24* (2006.01)
*G07F 17/32* (2006.01)

(52) U.S. Cl.
CPC ..... *G07F 17/3216* (2013.01)

(58) Field of Classification Search
CPC ..... G07F 17/3216; G07F 17/3211; G07F 17/3202
See application file for complete search history.

(56) References Cited

U.S. PATENT DOCUMENTS

| | | | | |
|---|---|---|---|---|
| 3,353,885 | A | 11/1967 | Hanson | |
| 6,201,532 | B1 | 3/2001 | Tode | |
| 6,643,124 | B1 * | 11/2003 | Wilk | G06F 1/1616 312/223.1 |
| 6,702,409 | B2 | 3/2004 | Hedrick | |
| 6,886,896 | B2 | 5/2005 | Hedrick | |
| 6,958,015 | B2 | 10/2005 | Luciano, Jr. | |
| 7,066,816 | B2 | 6/2006 | Gauselmann | |
| 7,513,830 | B2 | 4/2009 | Hajder | |
| 7,780,534 | B2 | 8/2010 | Wudtke | |
| 7,833,102 | B2 | 11/2010 | Beadell | |
| 7,862,436 | B2 | 1/2011 | Cole | |
| 7,985,139 | B2 | 7/2011 | Lind | |
| 8,038,526 | B2 | 10/2011 | Okada | |
| 8,167,715 | B2 | 5/2012 | Lesley | |
| 8,439,761 | B2 | 5/2013 | O'Keene | |
| 8,641,535 | B2 | 2/2014 | McComb | |
| 8,764,573 | B2 | 7/2014 | Johnson | |
| 2002/0041069 | A1 * | 4/2002 | Steelman | G07F 17/32 273/138.1 |

(Continued)

*Primary Examiner* — Steve Rowland
(74) *Attorney, Agent, or Firm* — Nixon Peabody LLP

(57) ABSTRACT

A gaming machine includes one or more display devices within a cabinet and configured to display a wagering game. The gaming machine further includes a top-box device having a top-box display facing a player position in front of the cabinet. The top-box device has a primary surface defined by a top edge, a bottom edge, and two side edges. The top-box device further has at least one side panel rotatably attached along one of the side edges of the top-box display and being movable between a plurality of positions in a range between a closed position and an open position.

20 Claims, 10 Drawing Sheets

(56) References Cited

U.S. PATENT DOCUMENTS

| | | | | |
|---|---|---|---|---|
| 2007/0111776 | A1* | 5/2007 | Griswold | G07F 17/32 463/16 |
| 2008/0311976 | A1* | 12/2008 | Hashimoto | G07F 17/3216 463/20 |
| 2009/0325692 | A1* | 12/2009 | Klostermann | G07F 17/3211 463/30 |
| 2010/0087249 | A1* | 4/2010 | Rowe | G07F 17/3216 463/31 |
| 2011/0070948 | A1* | 3/2011 | Bainbridge | G07F 17/3218 463/30 |
| 2011/0092265 | A1* | 4/2011 | Rinaldis | G07F 17/32 463/16 |
| 2012/0208645 | A1* | 8/2012 | Rodriguez | G07F 17/3211 463/46 |
| 2012/0283012 | A1* | 11/2012 | Bainbridge | G07F 17/3211 463/30 |

* cited by examiner

FIG. 4C
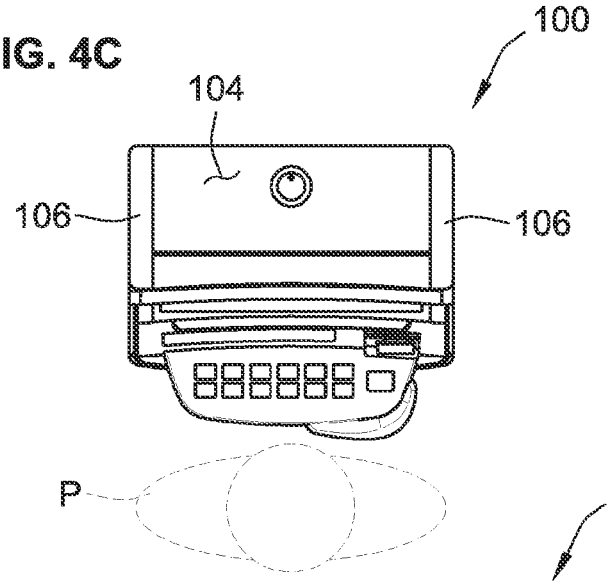
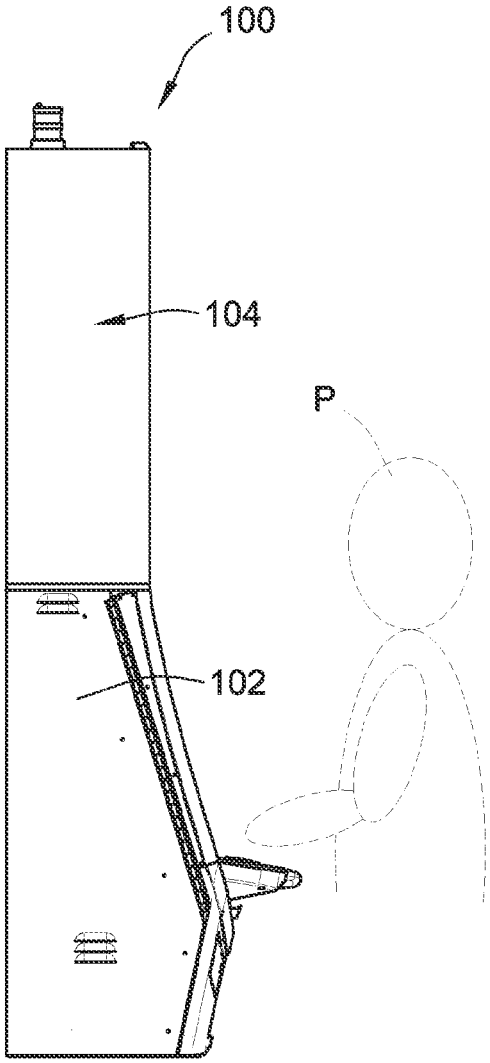
FIG. 4B
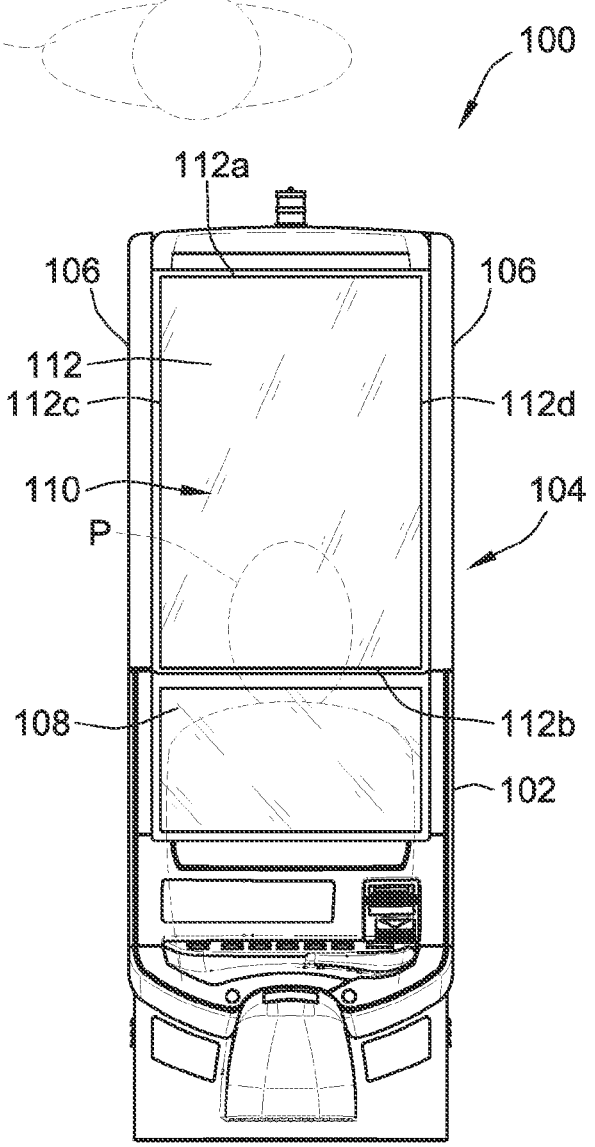
FIG. 4A

FIG. 5C
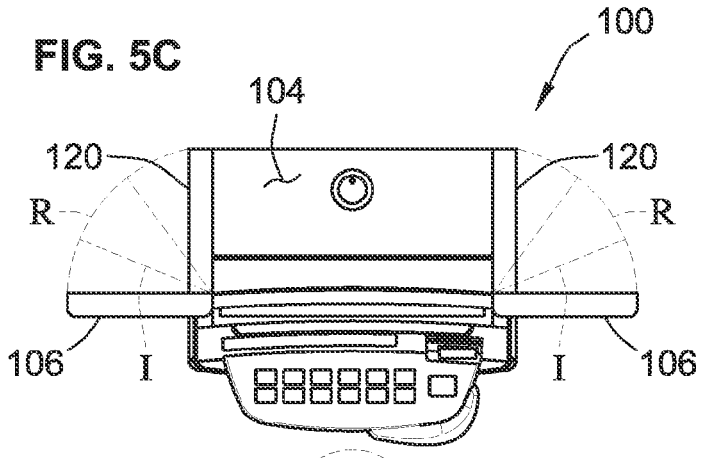
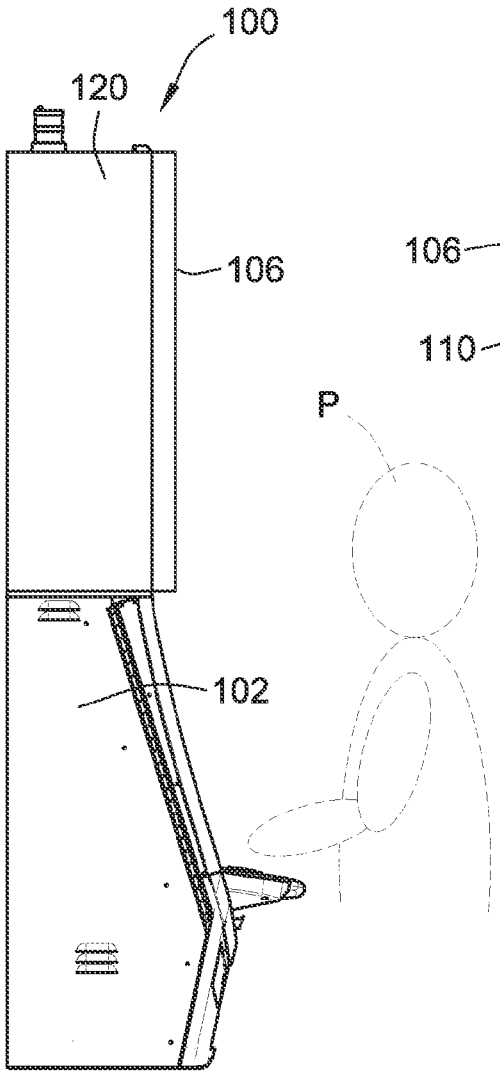
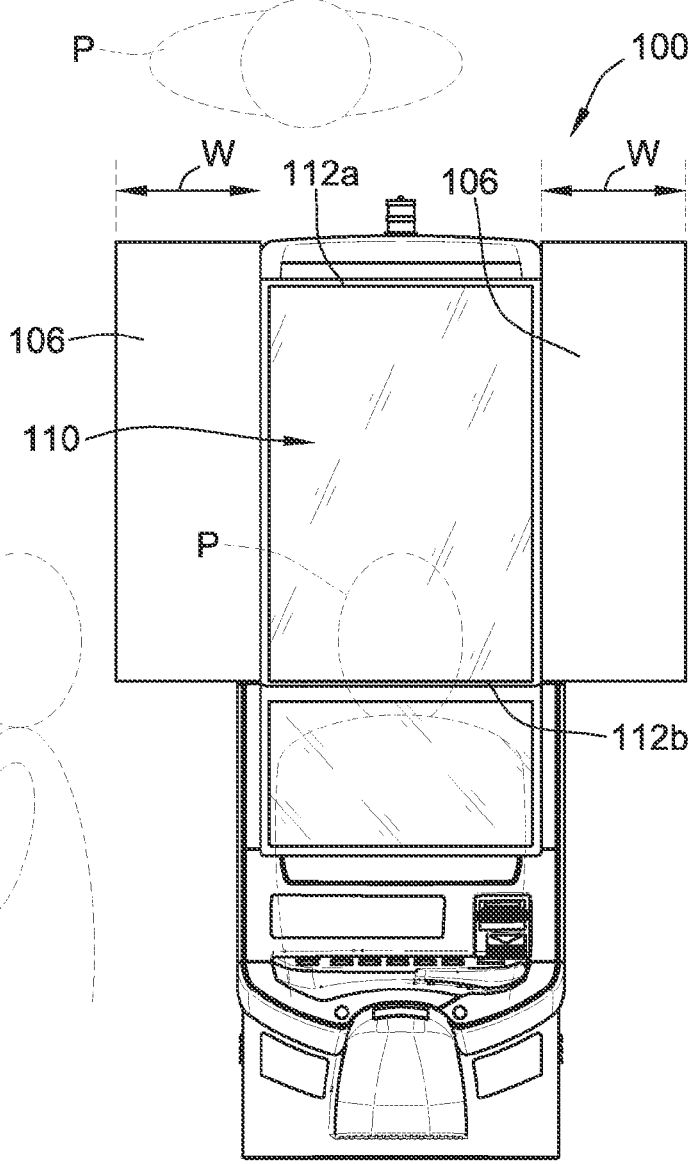
FIG. 5B
FIG. 5A

GAMING MACHINE HAVING MULTI-CONFIGURATION SIDE PANELS FOR VARIABLE WAGERING-GAME ENVIRONMENTS

CROSS-REFERENCE TO RELATED APPLICATIONS

This application claims the benefit of and priority to U.S. Provisional Patent Application No. 61/968,354 titled "Gaming Machine Having Multi-Configuration Side Panels For Variable Wagering-Game Environments" and filed on Mar. 20, 2014, which is incorporated herein by reference in its respective entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming apparatus and methods and, more particularly, to a gaming cabinet having movable side panels.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

SUMMARY OF THE INVENTION

According to one aspect of the present invention, a gaming machine includes a cabinet, one or more display devices, and a top-box device. The one or more display devices are within the cabinet and are configured to display a wagering game. The top-box device has a top-box display facing a player position in front of the cabinet and having a primary surface defined by a top edge, a bottom edge, and two side edges. The top-box device further has at least one side panel rotatably attached along one of the side edges of the top-box display and being movable between a plurality of positions in a range between a closed position and an open position.

According to another aspect of the invention, a gaming system includes a first gaming machine located in a first position on a gaming-establishment floor and a second gaming machine located in a second position on the gaming-establishment floor. The first gaming machine has a first cabinet, a first top-box display, and a first movable panel. The first top-box display faces a first player position in front of the first cabinet. The first movable panel is rotatably attached along a side of the top-box display and is movable between a first closed position and a first open position. The second gaming machine is located in the second position at a minimum distance X from the first position, and includes a second cabinet, a second top-box display, and a second movable panel. The second top-box display faces a second player position in front of the second cabinet. The second movable panel is rotatably attached along a side of the top-box display and is movable between a second closed position and a second open position. The minimum distance X between the first gaming machine and the second gaming machine is variable based on respective positions of the first movable panel and the second movable panel.

According to yet another aspect of the invention, a gaming machine has a cabinet having a primary surface and two sides, the primary surface facing a player position in front of the cabinet. The gaming machine further has one or more display devices and a top-box device. The display devices are within the cabinet and configured to display a wagering game. The top-box device has a top-box display facing the player position in front of the cabinet, and a movable panel rotatably attached to a rotational mount alongside of the top-box display. The movable panel has a secondary surface adjacent the rotational mount and a primary surface generally perpendicular to and sharing a common edge with the secondary surface. The secondary surface has a narrower width than the primary surface. In response to the movable panel being positioned in a closed position, the primary surface is generally parallel to the sides of the cabinet and the secondary surface is generally perpendicular to the sides of the cabinet. In response to the movable panel being positioned in an open position, the primary surface is generally perpendicular to the sides of the cabinet and the secondary surface is generally parallel to the sides of the cabinet.

Additional aspects of the invention will be apparent to those of ordinary skill in the art in view of the detailed description of various embodiments, which is made with reference to the drawings, a brief description of which is provided below.

BRIEF DESCRIPTION OF THE DRAWINGS

FIG. 4A is a front view of a gaming machine with a top-box display and movable side panels in a closed position.

FIG. 4B is a side view of the gaming machine of FIG. 4A.

FIG. 4C is a top view of the gaming machine of FIG. 4A.

FIG. 5A is a front view of the gaming machine of FIG. 4A with the movable side panels in an open position.

FIG. 5B is a side view of the gaming machine of FIG. 5A.

FIG. 5C is a top view of the gaming machine of FIG. 5A.

Figure 1:
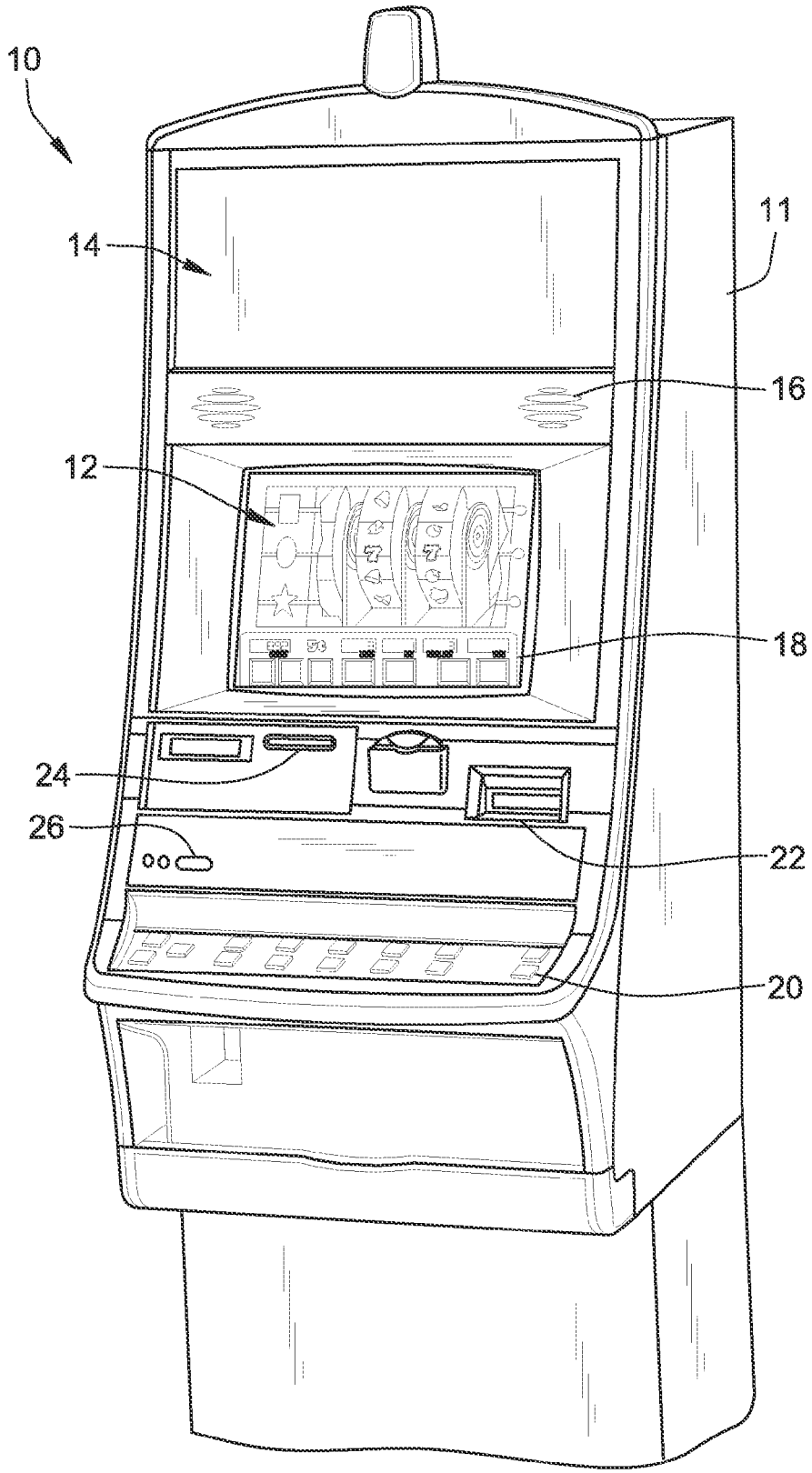
FIG. 1 (PRIOR ART)
FIG. 1 is a perspective view of a free-standing gaming machine according to an embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

For purposes of the present detailed description, the terms "wagering games," "gambling," "slot game," "casino game," and the like include games in which a player places at risk a sum of money or other representation of value, whether or not redeemable for cash, on an event with an uncertain outcome, including without limitation those having some element of skill. In some embodiments, the wagering game may involve wagers of real money, as found with typical land-based or on-line casino games. In other embodiments, the wagering game may additionally, or alternatively, involve wagers of non-cash values, such as virtual currency, and therefore may be considered a social or casual game, such as would be typically available on a social networking web site, other web sites, across computer networks, or applications on mobile devices (e.g., phones, tablets, etc.). When provided in a social or casual game format, the wagering game may closely resemble a traditional casino game, or it may take another form that more closely resembles other types of social/casual games.

Referring to FIG. 1, there is shown a gaming machine 10 similar to those used in gaming establishments, such as casinos. With regard to the present invention, the gaming machine 10 may be any type of gaming terminal or machine and may have varying structures and methods of operation. For example, in some aspects, the gaming machine 10 is an electromechanical gaming terminal configured to play mechanical slots, whereas in other aspects, the gaming machine is an electronic gaming terminal configured to play a video casino game, such as slots, keno, poker, blackjack, roulette, craps, etc. The gaming machine 10 may take any suitable form, such as floor-standing models as shown, handheld mobile units, bartop models, workstation-type console models, etc. Further, the gaming machine 10 may be primarily dedicated for use in conducting wagering games, or may include non-dedicated devices, such as mobile phones, personal digital assistants, personal computers, etc. Exemplary types of gaming machines are disclosed in U.S. Pat. No. 6,517,433 and Patent Application Publication Nos. US2010/0069160 and US2010/0234099, which are incorporated herein by reference in their entireties.

The gaming machine 10 illustrated in FIG. 1 comprises a cabinet 11 that may house various input devices, output devices, and input/output devices. By way of example, the gaming machine 10 includes a primary display area 12, a secondary display area 14, and one or more audio speakers 16. The primary display area 12 or the secondary display area 14 may be a mechanical-reel display, a video display, or a combination thereof in which a transmissive video display is disposed in front of the mechanical-reel display to portray a video image superimposed upon the mechanical-reel display. The display areas may variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming machine 10. The gaming machine 10 includes a touch screen(s) 18 mounted over the primary or secondary areas, buttons 20 on a button panel, bill validator 22, information reader/writer(s) 24, and player-accessible port(s) 26 (e.g., audio output jack for headphones, video headset jack, USB port, wireless transmitter/receiver, etc.). It should be understood that numerous other peripheral devices and other elements exist and are readily utilizable in any number of combinations to create various forms of a gaming machine in accord with the present concepts.

Input devices, such as the touch screen 18, buttons 20, a mouse, a joystick, a gesture-sensing device, a voice-recognition device, and a virtual-input device, accept player input(s) and transform the player input(s) to electronic data signals indicative of the player input(s), which correspond to an enabled feature for such input(s) at a time of activation (e.g., pressing a "Max Bet" button or soft key to indicate a player's desire to place a maximum wager to play the wagering game). The input(s), once transformed into electronic data signals, are output to a game-logic circuitry for processing. The electronic data signals are selected from a group consisting essentially of an electrical current, an electrical voltage, an electrical charge, an optical signal, an optical element, a magnetic signal, and a magnetic element.

Figure 2:
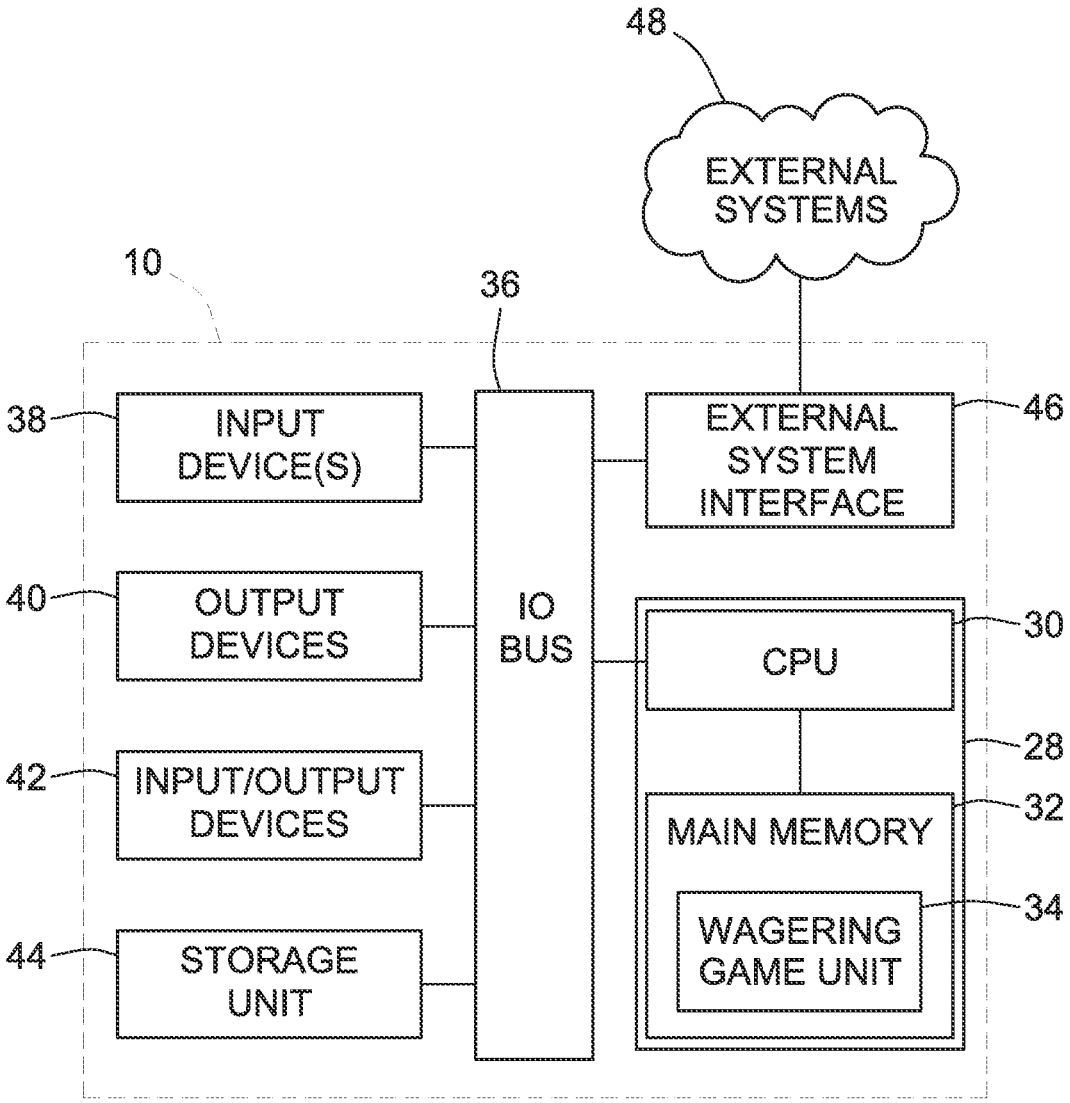
FIG. 2 (PRIOR ART)
FIG. 2 is a schematic view of a gaming system according to an embodiment of the present invention.

Turning now to FIG. 2, there is shown a block diagram of the gaming-machine architecture. The gaming machine 10 includes game-logic circuitry 28 having a central processing unit (CPU) 30 connected to a main memory 32. The CPU 30 may include any suitable processor(s), such as those made by Intel and AMD. By way of example, the CPU 30 may include a plurality of microprocessors including a master processor, a slave processor, and a secondary or parallel processor. Game-logic circuitry 28, as used herein, comprises any combination of hardware, software, or firmware disposed in or outside of the gaming machine 10 that is configured to communicate with or control the transfer of data between the gaming machine 10 and a bus, another computer, processor, device, service, or network. The game-logic circuitry 28, and more specifically the CPU 30, comprises one or more controllers or processors and such one or more controllers or processors need not be disposed proximal to one another and may be located in different devices or in different locations. The game-logic circuitry 28, and more specifically the main memory 32, comprises one or more memory devices which need not be disposed proximal to one another and may be located in different devices or in different locations. The game-logic circuitry 28 is operable to execute all of the various gaming methods and other processes disclosed herein. The main memory 32 includes a wagering-game unit 34. In one embodiment, the wagering-game unit 34 may cause wagering games to be presented, such as video poker, video black jack, video slots, video lottery, etc., in whole or part.

The game-logic circuitry 28 is also connected to an input/output (I/O) bus 36, which can include any suitable bus technologies, such as an AGTL+ frontside bus and a PCI backside bus. The I/O bus 36 is connected to various input devices 38, output devices 40, and input/output devices 42 such as those discussed above in connection with FIG. 1. The I/O bus 36 is also connected to a storage unit 44 and an external-system interface 46, which may be connected to external system(s) 48 (e.g., wagering-game networks).

The external system 48 includes, in various aspects, a gaming network, other gaming machines or terminals, a gaming server, a remote controller, communications hardware, or a variety of other interfaced systems or components, in any combination. In yet other aspects, the external system 48 may comprise a player's portable electronic device (e.g., cellular phone, electronic wallet, etc.) and the external-system interface 46 is configured to facilitate wireless communication and data transfer between the portable electronic device and the gaming machine 10, such as by a near-field communication path operating via magnetic-field induction or a frequency-hopping spread spectrum RF signals (e.g., Bluetooth, etc.).

The gaming machine 10 optionally communicates with the external system 48 such that the gaming machine 10 operates as a thin, thick, or intermediate client. The game-logic circuitry 28—whether located within ("thick client"), external to ("thin client"), or distributed both within and external to ("intermediate client") the gaming machine 10—is utilized to provide a wagering game on the gaming machine 10. In general, the main memory 32 (comprising one or more memory devices) stores programming for an RNG, game-outcome logic, and game assets (e.g., art, sound, etc.). When a wagering-game instance is executed, the CPU 30 (comprising one or more processors or controllers) executes the RNG programming to generate one or more pseudo-random numbers. The pseudo-random numbers are utilized by the CPU 30 when executing the game-outcome logic to determine a resultant outcome for that instance of the wagering game. The resultant outcome is then presented to a player of the gaming machine 10 by accessing the associated game assets, required for the resultant outcome, from the main memory 32. The CPU 30 causes the game assets to be presented to the player as outputs from the gaming machine 10 (e.g., audio and video presentations).

The gaming machine 10 may include additional peripheral devices or more than one of each component shown in FIG. 2. Any component of the gaming-machine architecture may include hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic-disk storage media, optical storage media, flash memory, etc.

Figure 3:
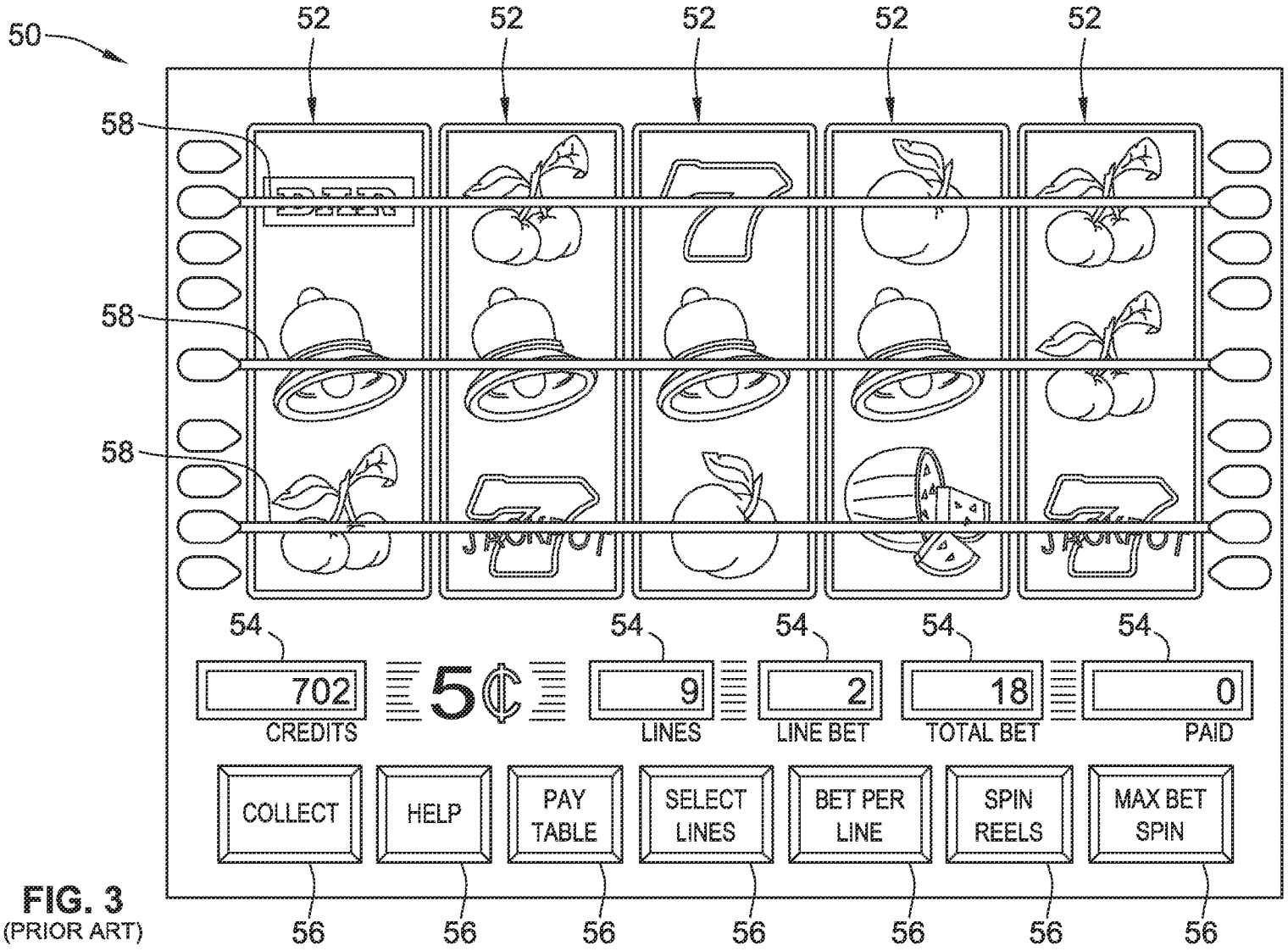
FIG. 3 (PRIOR ART)
FIG. 3 is an image of an exemplary basic-game screen of a wagering game displayed on a gaming machine, according to an embodiment of the present invention.

Referring now to FIG. 3, there is illustrated an image of a basic-game screen 50 adapted to be displayed on the primary display area 12 or the secondary display area 14. The basic-game screen 50 portrays a plurality of simulated symbol-bearing reels 52. Alternatively or additionally, the basic-game screen 50 portrays a plurality of mechanical reels or other video or mechanical presentation consistent with the game format and theme. The basic-game screen 50 also advantageously displays one or more game-session credit meters 54 and various touch screen buttons 56 adapted to be actuated by a player. A player can operate or interact with the wagering game using these touch screen buttons or other input devices such as the buttons 20 shown in FIG. 1. The game-logic circuitry 28 operates to execute a wagering-game program causing the primary display area 12 or the secondary display area 14 to display the wagering game.

In response to receiving an input indicative of a wager, the reels 52 are rotated and stopped to place symbols on the reels in visual association with paylines such as paylines 58. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering-game outcome is provided or displayed in response to the wager being received or detected. The wagering-game outcome, for that particular wagering-game instance, is then revealed to the player in due course following initiation of the wagering game. The method comprises the acts of conducting the wagering game using a gaming apparatus, such as the gaming machine 10 depicted in FIG. 1, following receipt of an input from the player to initiate a wagering-game instance. The gaming machine 10 then communicates the wagering-game outcome to the player via one or more output devices (e.g., primary display 12 or secondary display 14) through the display of information such as, but not limited to, text, graphics, static images, moving images, etc., or any combination thereof. In accord with the method of conducting the wagering game, the game-logic circuitry 28 transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the game-logic circuitry 28 is configured to process the electronic data signal, to interpret the data signal (e.g., data signals corresponding to a wager input), and to cause further actions associated with the interpretation of the signal in accord with stored instructions relating to such further actions executed by the controller. As one example, the CPU 30 causes the recording of a digital representation of the wager in one or more storage media (e.g., storage unit 44), the CPU 30, in accord with associated stored instructions, causes the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM), etc. The noted second state of the data storage media comprises storage in the storage media of data representing the electronic data signal from the CPU 30 (e.g., the wager in the present example). As another example, the CPU 30 further, in accord with the execution of the stored instructions relating to the wagering game, causes the primary display 12, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of the stored instructions relating to the wagering game is further conducted in accord with a random outcome (e.g., determined by the RNG) that is used by the game-logic circuitry 28 to determine the outcome of the wagering-game instance. In at least some aspects, the game-logic circuitry is configured to determine an outcome of the wagering-game instance at least partially in response to the random parameter.

Referring to FIGS. 4A-4C, a gaming machine 100 has a cabinet 102 and a top-box device 104 with a pair of movable side panels 106. According to one example, the gaming machine 100 is similar or identical, with similar or identical components, to the gaming machine 10 described above and illustrated in FIGS. 1 and 2. The gaming machine 100 further includes a display device 108 that is located within the cabinet and that is configured to display a wagering game. The wagering game, for example, includes game screens similar or identical to the basic-game screen 50 described above and illustrated in FIG. 3, and operates as described above.

The top-box device 104 is located above the cabinet 102 and may include a top-box display 110, which according to one example is a liquid-crystal display (LCD). The top-box display 110 faces a player position P in front of the cabinet and has a forward viewable surface 112 defined by a top edge 112*a*, a bottom edge 112*b*, and two side edges 112*c*, 112*d* (which include a left side edge 112*c* and a right side edge 112*d*). The top-box display 110, according to one example, is narrower than the cabinet 102.

The movable side panels 106, which are generally, but not necessarily, identical, are mounted on opposite sides of the top-box display 110. Each side panel 106 is rotatably attached along a respective side edge 112*c*, 112*d* of the top-box display 110 and is movable between a plurality of positions that range between a closed position a fully open position. In FIGS. 4A-4C, the side panels 106 are illustrated in the closed position.

As illustrated in FIGS. 4A-C, when the side panels 106 are in the closed position, they are generally aligned with the sides of cabinet 102. In embodiments where the top-box display 110 is narrower than the cabinet 102, the side panels 106 are designed such that the width of the top-box display and the side panels 106 in the closed position is no greater than the width of the gaming cabinet 102. As such, transportation and packing costs can be reduced as a single packing infrastructure can be utilized to transport all of the gaming machines 100, regardless of what their final configuration is desired to be. In other words, and as will be described in more detail with respect to the following figures, a single gaming machine 100 having a relatively slim profile during shipping can result in various configurations on a casino floor, and can occupy a much larger footprint than that which is required for shipping.

Referring to FIGS. 5A-5C, the side panels 106 are illustrated in an open position. In the open position, each of the side panels 106 is generally parallel to the top-box display 110 and generally orthogonal to the cabinet sides 120, extending outwardly form the cabinet sides 120 a distance W equal to the respective width of each side panel 106.

In this embodiment, the side panels 106 are movable in a range of motion R between the closed position and the open position. Optionally, the range of motion R includes intermediate positions I in which the side panels 106 are temporarily or permanently fixed. In other embodiments, such as the embodiment illustrated in FIG. 8B, the fully open position for the side panels 106*a*, 106*b* can extend from the top-box display 110 in the direction of the player to run generally in parallel with the cabinet sides 120. In these embodiments, R may have a range of motion that is slightly greater than 180 degrees.

Figure 6:
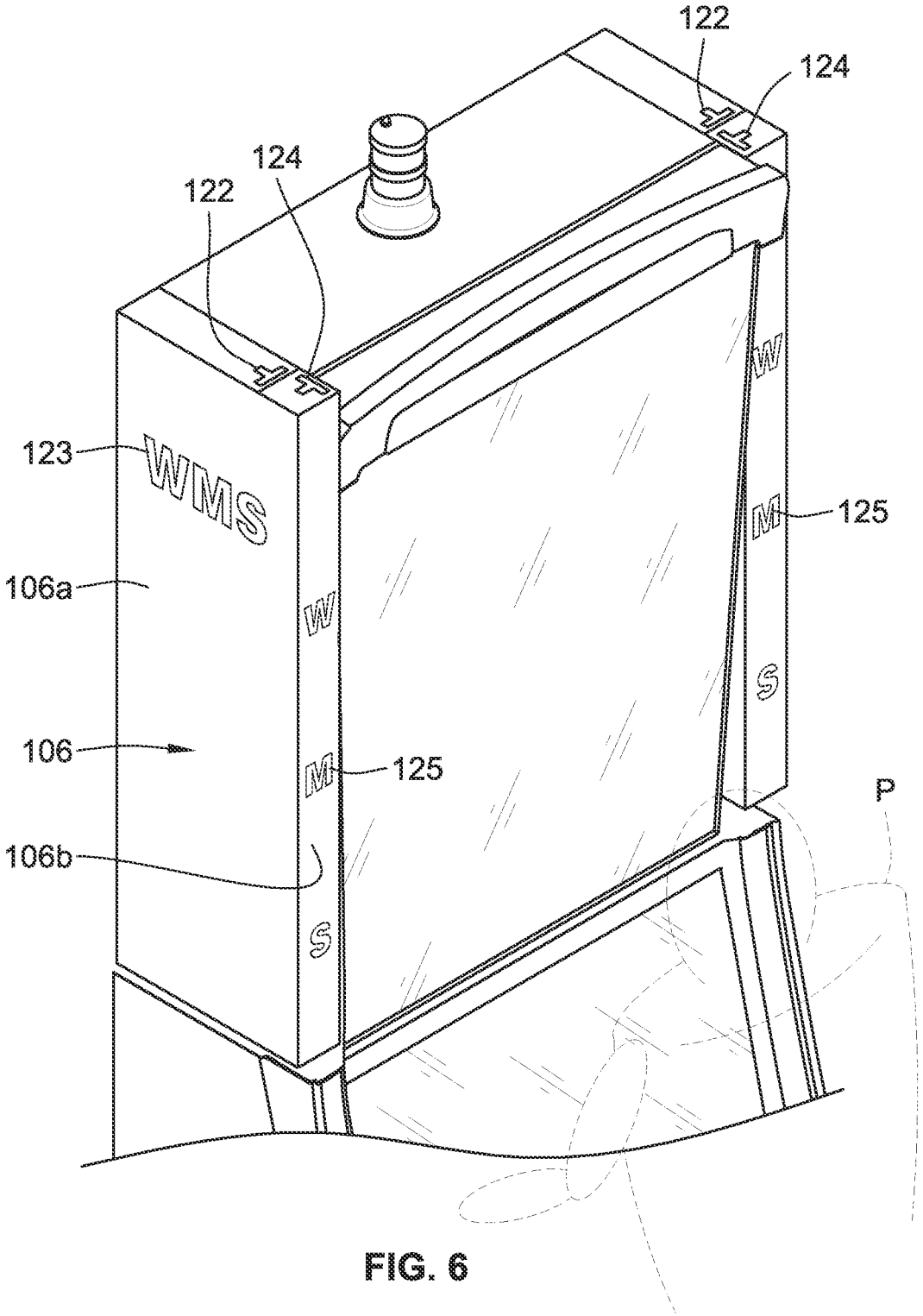
FIG. 6 is a partial enlarged perspective view of the gaming machine of FIG. 4A.

Referring to FIG. 6, each side panel 106 includes a primary surface 106*a* and an adjacent secondary surface 106*b*. The primary surface has a larger surface area and/or a greater width than the secondary surface, and, as such, can accommodate a greater display area than the secondary surface. Thus, the primary surface can include larger artwork and/or display devices than the secondary surface for displaying wagering information for players and/or non-players.

In the open position of the side panel 106, the primary surface 106*a* is visible from the player position P, while the secondary surface 106*b* is obscured from view from the player position P. In the closed position of the side panel 106, the secondary surface 106*b* is visible from the player position P, while the primary surface 106*a* is typically (but not necessarily) obscured from view from the player position P.

Each side panel 106 may further include an illumination feature with one or more controllable light-emitting diodes (LEDs). For example, one or more front LEDs 122 are configured to illuminate artwork 123 viewable in the primary surface 106*a* of the side panel 106. Similarly one or more front-side LEDs 124 are configured to illuminate artwork 125 viewable in the secondary surface 106*b*.

Optionally, one or more of the side panels 106 may include a display, such as an LCD display. For example, at least one of the side panels 106 is an LCD display that displays gameplay information, including video artwork.

Figure 7:
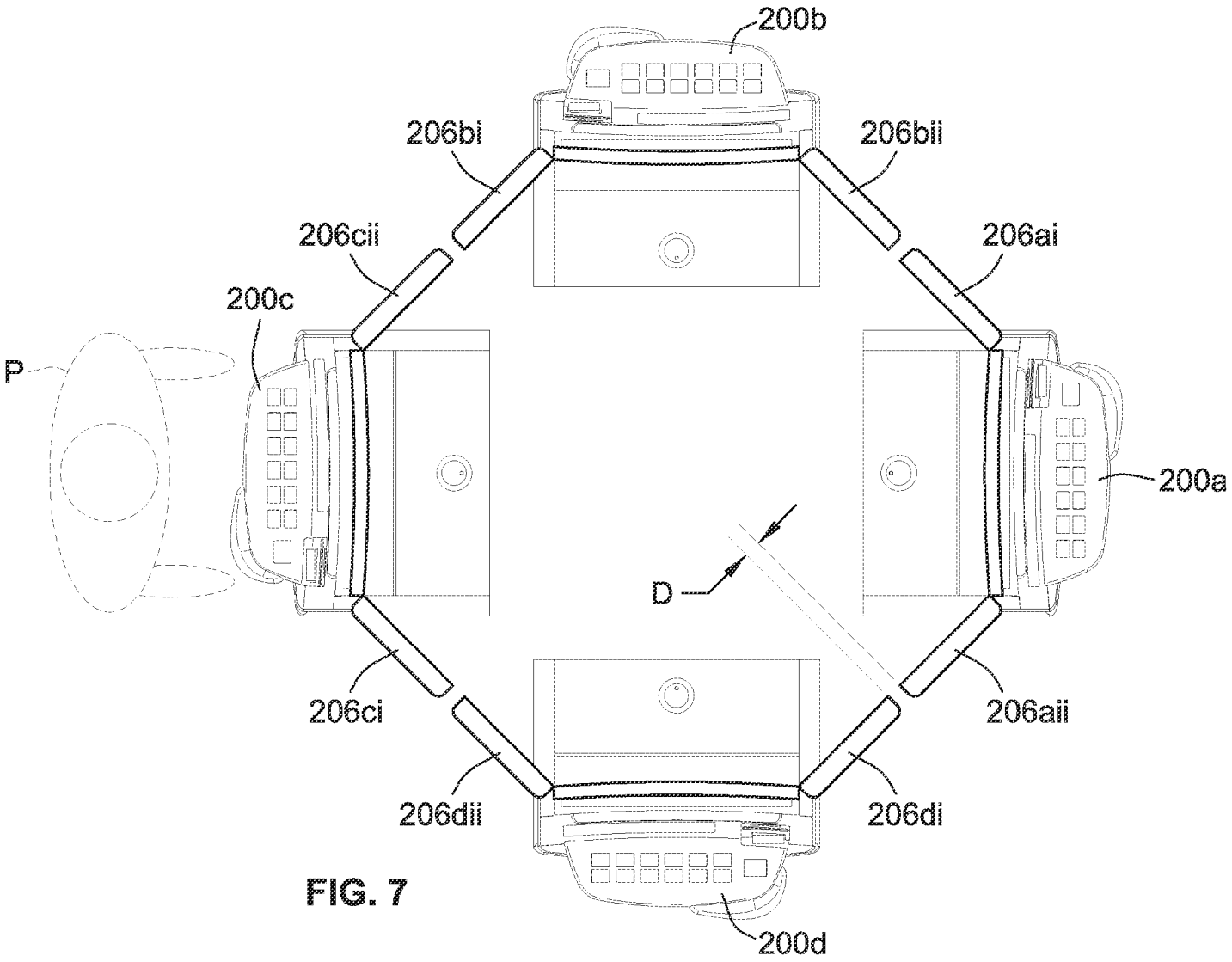
FIG. 7 is a top view of a gaming system in which a plurality of gaming machines are arranged in a rectangular pattern with movable sides in the open position.

Referring to FIG. 7, a game-machine configuration includes four game machines 200*a*-200*d* arranged in a closed loop configuration. In the illustrated example, side panels of the game machines 200*a*-200*d* are in an open position extending towards and near adjacent ones of the side panels. For example, a first side panel 206*ai* of a first gaming machine 200*a* is near an adjacent second side panel 206*bii* of a second gaming machine 200*b*. A second side panel 206*aii* of the first gaming machine 200*a* is near an adjacent first side panel 206*di* of a fourth gaming machine 200*d*.

According the illustrated configuration, the side panels of the gaming machines are beneficial in obscuring space between the gaming machines and providing a unified feel and look to the gaming machines. For example, if a gaming establishment prefers to emphasize a team-play aspect of a wagering game, the closed loop configuration is likely to provide a teamwork-type of ambience for the players.

Another benefit of the illustrated configuration includes artwork and/or other information included on the side panels that further enhance the gameplay experience. Advertisements and/or game-play information can be provided on the side panels to attract non-players to respective wagering games of the gaming machines 200*a*-200*d*.

Based on available space on a wagering establishment floor, the gaming machines 200*a*-200*d* are arranged closer or farther from each other. If a close configuration is desired, the side panels of the gaming machines 200*a*-200*d* are close to or in contact with each other. If a spread-out configuration is desired, the side panels of the gaming machines 200*a*-200*d* are moved such that a desired in-between distance D is achieved.

Although the illustrated configuration has a generally rectangular shape, the gaming machines 200*a*-200*d* can be arranged such that other shapes (e.g., circular) can be achieved. In fact, many other shapes and configurations can be achieved, based on available floor space and desired appearance, by moving the gaming machines and/or the one or more of the side panels.

Figure 8A:
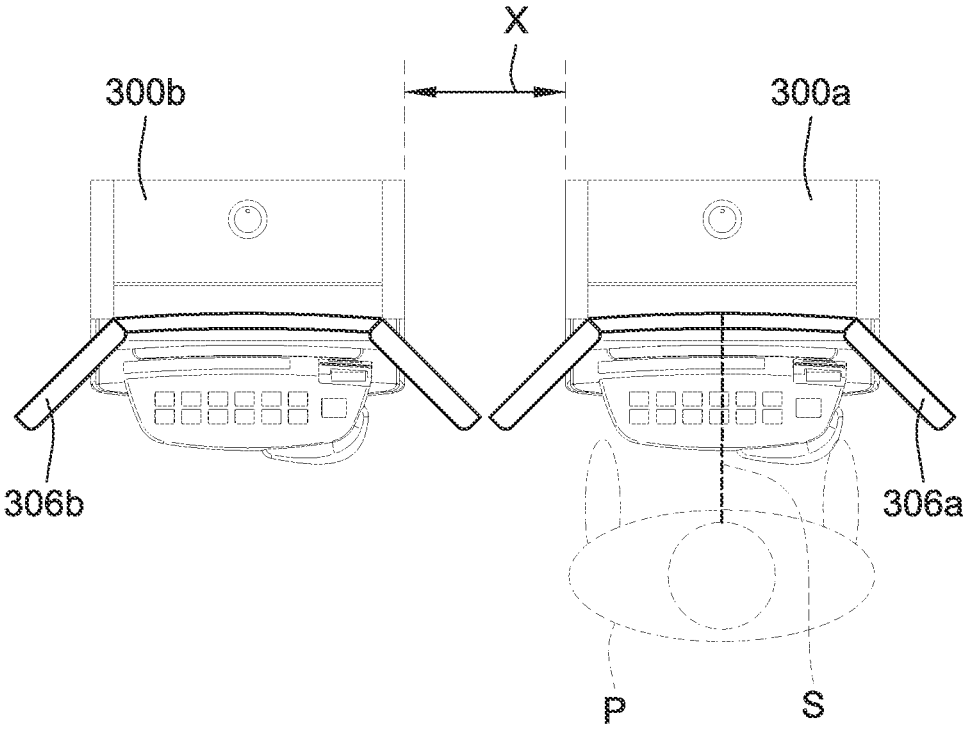
FIG. 8A is a top view of a pair of gaming machines arranged in a side-by-side configuration with movable sides in a partially-open position.
Figure 8B:
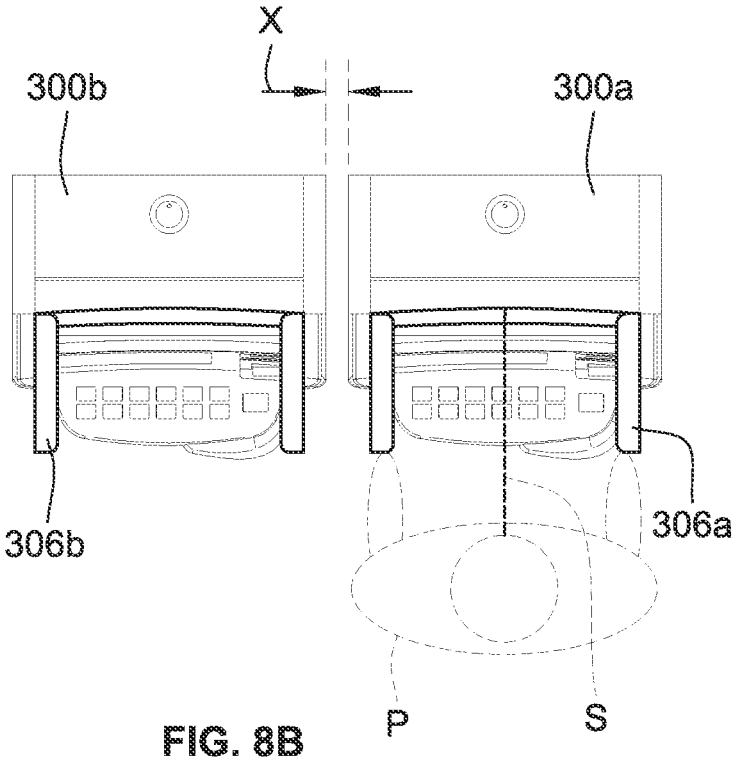
FIG. 8B illustrates the gaming machines of FIG. 8A with the movable sides in a closed position directed towards a player position.
Figure 8C:
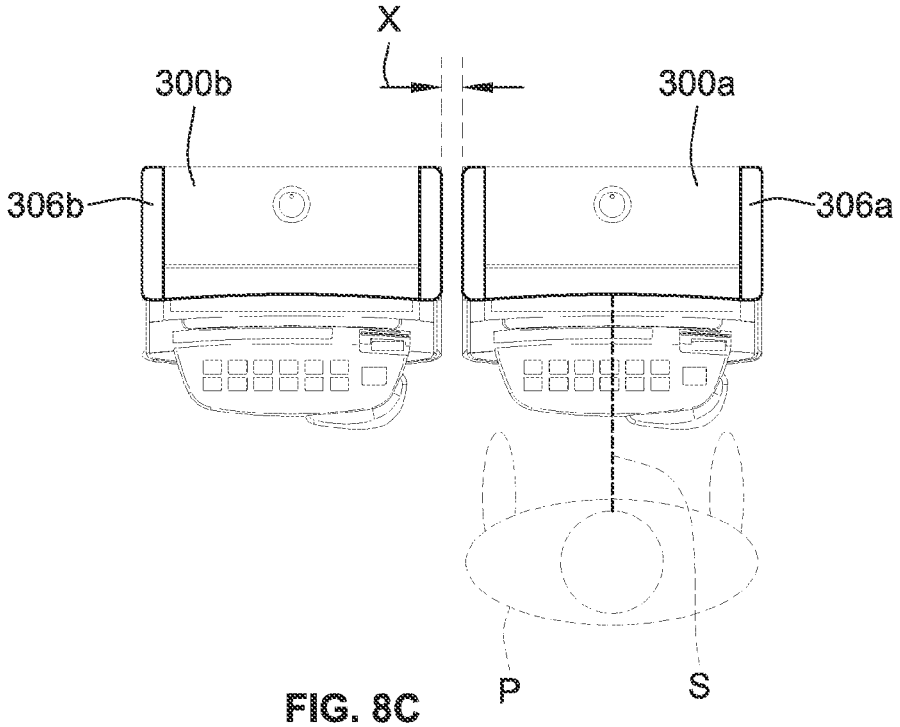
FIG. 8C illustrates the gaming machine of FIG. 8A with the movable sides in a closed position directed away from the player position.

Referring to FIGS. 8A-8C, additional illustrative game-machine configurations includes two gaming machines 300*a*, 300*b*, arranged in a side-by-side configuration. In this configuration, and as illustrated in FIG. 8A, side panels 306*a*, 306*b* are angled toward the respective player position P and the gaming machines 300*a*, 300*b* are positioned at a distance X from each other. The distance X is variable based on respective positions of the side panels 306*a*, 306*b*. Thus, the distance X can change by adjusting the side panels 306*a*, 306*b* to any of the available side-panel positions and/or by moving the gaming machines 300*a*, 300*b* on the floor of the gaming establishment.

In FIG. 8A, the illustrative configuration shows that the side panels 306*a*, 306*b*, are not generally perpendicular to a direct line of sight S between the player position P and the respective gaming machine 300*a*, 300*b*. As such, because the side panels 306*a*, 306*b* are oriented at least in part towards the respective player, the side panels 306*a*, 306*b* are useful in displaying information to the player in addition to the information displayed by the displays of the gaming machines 300*a*, 300*b*. Thus, according to one example, one or more of the side panels 306*a*, 306*b* serve as extensions of the displays of the gaming machines 300*a*, 300*b*, and display additional game-play or other wagering game information.

Optionally, as illustrated in FIG. 8B, the side panels 306*a*, 306*b* are movable towards the player to a parallel position relative to the line of sight S, between the player position P and the respective gaming machine 300*a*, 300*b*. In this position, the gaming machines 300*a*, 300*b* are closer to each other than in the position illustrated in FIG. 8A (i.e., distance X is smaller in FIG. 8B than in FIG. 8A). Based on the parallel position, the side panels 306*a*, 306*b* are now configured such that they provide, at least in part, a divider between the two adjacent gaming machines 300*a*, 300*b*. Thus, this illustrated configuration provides an enhanced sense of privacy for the players.

In FIG. 8C, the illustrative configuration shows that the side panels 306*a*, 306*b* are further movable away form the player to a parallel position relative to the line of sight S, between the player position P and the respective gaming machine 300*a*, 300*b*. In this position, the side panels 306*a*, 306*b* are tucked away between the gaming machines 300*a*, 300*b*.

Figure 9:
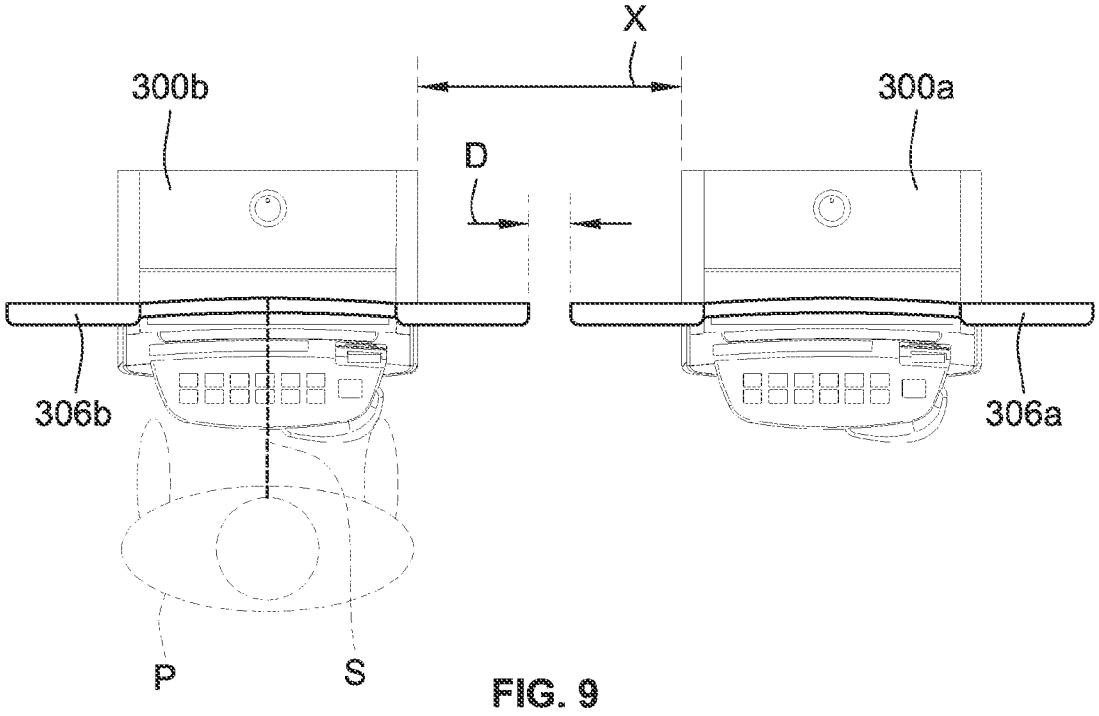
FIG. 9 illustrates the gaming machines of FIG. 8A with the movable sides in the open position.

Referring to FIG. 9, yet another illustrative game-machine configuration includes two adjacent gaming machines 300*a*, 300*b* that are arranged in a fully extended side-by-side configuration at a distance X from each other. The side panels 306*a*, 306*b* are fully extended and are illustrated with a distance D between adjacent edges. Optionally, the adjacent edges of internal side panels 306*a*, 306*b* are in contact with each other (i.e., the distance D is zero). One benefit of this configuration is that it provides an option for a gaming establishment to fill-up a large floor footprint with fewer gaming machines while reducing the appearance of an empty MOM.

Figure 10:
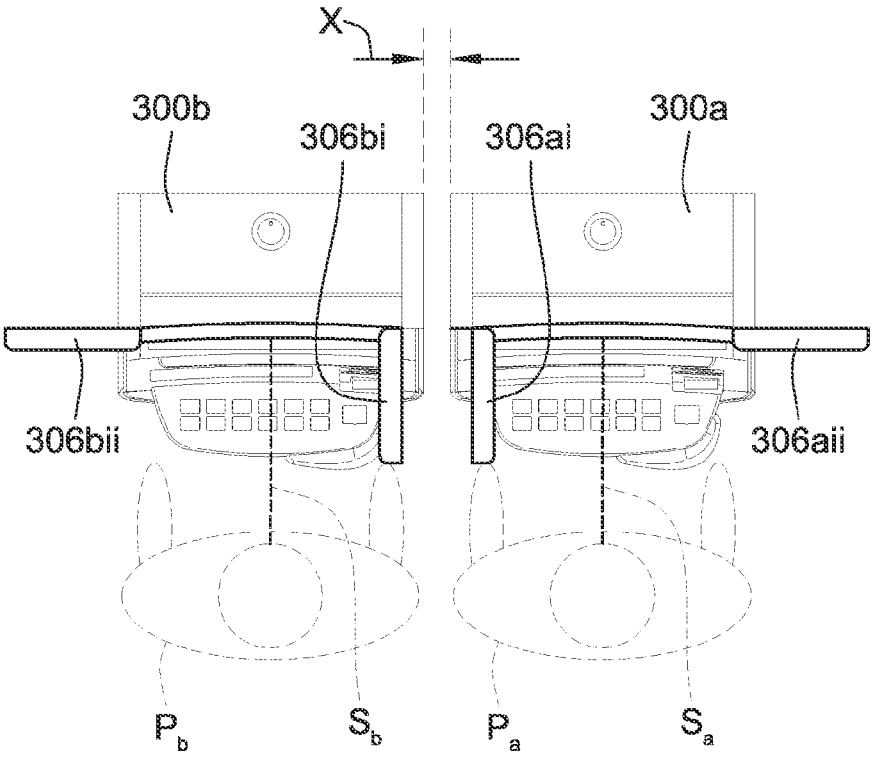
FIG. 10 illustrates the gaming machines of FIG. 8A with two movable sides in the open position and two movable sides in a closed position directed towards the player position.

Referring to FIG. 10, a modified option of the game-machine configuration illustrated in FIG. 9 shows side panels of the same gaming machine in different positions than each other. For example, adjacent (internal) side panels 306*ai*, 306*bi*, are generally positioned towards the players and parallel to the respective direct lines of sight Sa, Sb between the gaming machines 300*a*, 300*b*, and the player positions Pa, Pb. The non-adjacent (external) side panels 306*aii*, 306*bii*, are generally perpendicular to the respective direct lines of sight Sa, Sb. Accordingly, in this configuration the distance X between the gaming machines 300*a*, 300*b* is much smaller than in the configuration illustrated in FIG. 9.

In fact, the distance X can range between a low-minimum distance Xmin and a high-minimum distance Xmax based on the positions of the side panels 306*ai*, 306*aii*, 306*bi*, 306*bii*. For example, the low-minimum distance Xmin is achieved when the adjacent side panels 306*ai*, 306*bi* are in their respective closed positions as illustrated in FIG. 10 (i.e., the adjacent side panels 306*ai*, 306*bi*, are generally parallel to the respective direct lines of sight Sa, Sb). The high-minimum distance Xmax is achieved when the adjacent side panels 306*ai*, 306*bi* are in their respective open positions (i.e., the adjacent side panels 306*ai*, 306*bi* are generally perpendicular to the respective direct lines of sight Sa, Sb).

One benefit of the configuration illustrated in FIG. 10 is that gaming machines can be paired in two-machine combinations while maintaining at least partial display privacy. For example, this configuration is likely to be a preferred option when a wagering game includes a head-to-head or one-one-one competition. The two competing players are likely to enjoy being proximal to each other (e.g., for purposes of taunting each other), but still maintain private certain game-play information (e.g., maintain certain "secret advantages" obscured from the competing player).

Figure 11:
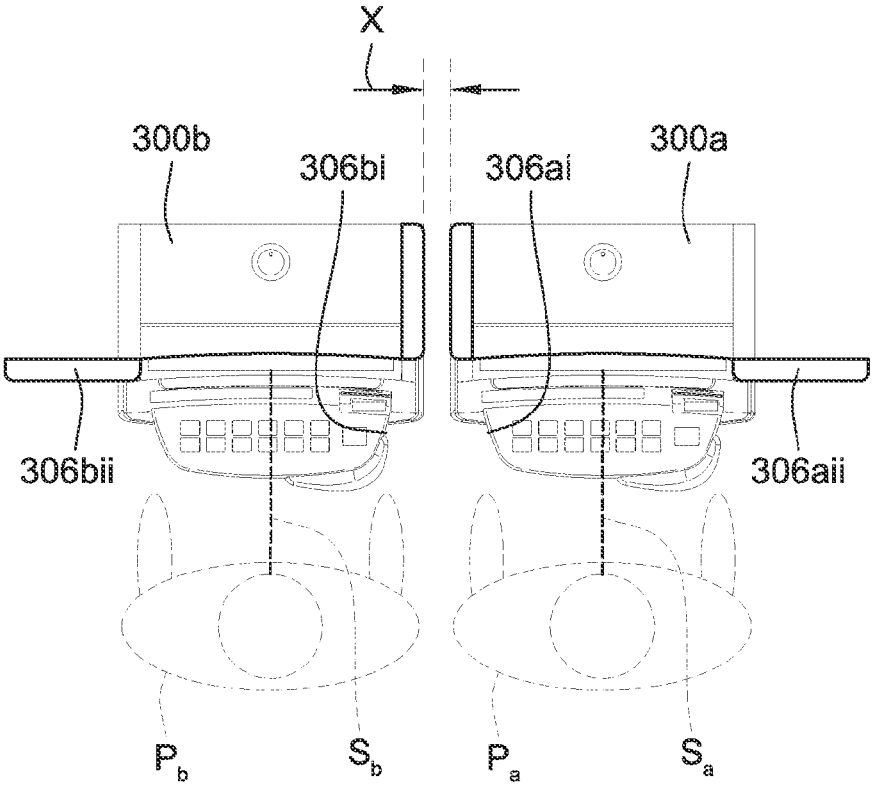
FIG. 11 illustrates the gaming machines of FIG. 10 with two movable sides in a closed position directed away from the player position.

Referring to FIG. 11, another modified option of the game-machine configuration illustrated in FIG. 9 shows the adjacent side panels 306*ai*, 306*bi* positioned away from the players, in a generally parallel orientation relative to he respective direct lines of sight Sa, Sb. In this configuration, the presence of the adjacent side panels 306*ai*, 306*bi* is minimized as they are tucked away between the gaming machines 300*a*, 300*b*.

Each of these embodiments and obvious variations thereof is contemplated as falling within the spirit and scope of the claimed invention, which is set forth in the following claims. Moreover, the present concepts expressly include any and all combinations and subcombinations of the preceding elements and aspects.

What is claimed is:

1. A gaming machine comprising:

a cabinet;

one or more display devices within the cabinet and configured to display a wagering game; and a top-box device having a top-box display facing a player position in front of the cabinet and having a front viewable surface defined by a pair of opposing top and bottom display edges and a pair of opposing side display edges extending between the top and bottom display edges, and at least one side panel defined by a pair of opposing top and bottom panel edges and a pair of opposing side panel edges extending between the top and bottom panel edges, one of the side panel edges being rotatably attached and coincident with one of the side display edges of the top-box display, the side panel and being rotatably movable between a plurality of positions in a range between a closed position and a first open position, the side panel being fixed along the one of the side display edges and extending at least between the top and bottom display edges.

2. The gaming machine of claim 1, wherein the at least one side panel includes a primary surface and an adjacent secondary surface, the primary surface being visible from the player position in the first open position, the secondary surface being obscured from view from the player position in the first open position.

3. The gaming machine of claim 2, wherein the primary surface is obscured from view from the player position in the closed position, the secondary surface being visible from the player position in the closed position.

4. The gaming machine of claim 2, wherein the plurality of positions includes at least one intermediate position in which both the primary surface and the secondary surface are visible, at least in part, from the player position.

5. The gaming machine of claim 2, wherein the primary surface has a larger surface area than the secondary surface.

6. The gaming machine of claim 5, wherein the primary surface is wider than the secondary surface.

7. The gaming machine of claim 2, wherein at least one of the primary surface and the secondary surface includes an illumination feature.

8. The gaming machine of claim 7, wherein the illumination feature includes controllable light-emitting diodes (LEDs).

9. The gaming machine of claim 8, wherein the LEDs include one or more first LEDs positioned to illuminate the primary surface and one or more second LEDs positioned to illuminate the secondary surface.

10. The gaming machine of claim 7, wherein at least one of the primary surface and the secondary surface includes artwork illuminated via the illumination feature.

11. A gaming system comprising:

a first gaming machine located in a first position on a gaming-establishment floor and having a first cabinet, a first top-box display facing a first player position in front of the first cabinet and having a front viewable surface defined by a pair of opposing top and bottom display edges and a pair of opposing side display edges extending between the top and bottom display edges, and a pair of opposing side panel edges extending between the top and bottom panel edges, one of the side panel edges being rotatably attached and coincident with one of the side display edges of the top-box display, the first movable panel being rotatably movable between a first closed position and a first open position, the first open position being orthogonal to the side of the top-box display, the first movable panel being fixed along the one of the display edges and extending at least between the top and bottom display edges; and a second gaming machine located in a second position on the gaming-establishment floor, the second position being at a minimum distance X from the first position, the second gaming machine having a second cabinet, a second top-box display facing a second player position in front of the second cabinet, and a second movable panel rotatably attached along a side of the second top-box display and being movable between a second closed position and a second open position, the second open position being orthogonal to the side of the second top-box display;

wherein the minimum distance X is variable based on respective positions of the first movable panel and the second movable panel.

12. The gaming system of claim 11, wherein the minimum distance X has a range between a low-minimum distance Xmin and a high-minimum distance Xmax, the low-minimum distance Xmin being achieved when the first movable panel is positioned in the first closed position and the second movable panel is positioned in the second closed position, the high-minimum distance Xmax being achieved when the first movable panel is positioned in the first open position and the second movable panel is positioned in the second open position.

13. The gaming system of claim 11, wherein the first movable panel has a first secondary surface that is visible from the first player position when the first panel is in the first closed position, the second movable panel having a second secondary surface that is visible from the second player position when the second panel is in the second closed position; and wherein the first secondary surface is obscured from view from the first player position in the first open position, the second secondary surface being obscured from view from the second player position in the second open position.

14. The gaming system of claim 11, wherein at least one of the first movable panel and the second movable panel includes an illumination feature.

15. The gaming system of claim 14, wherein the illumination feature includes a plurality of controllable light-emitting diodes (LEDs), at least one of the plurality of controllable LEDs being positioned to illuminate a primary surface of a respective one of the first movable panel and the second panel, at least another one of the plurality of controllable LEDs being positioned to illuminate a secondary surface of a respective one of the first movable panel and the second movable panel, the primary surface having a common edge with and being generally perpendicular relative to the secondary surface.

16. The gaming system of claim 11, wherein at least one of the first movable panel and the second movable panel includes illuminated artwork on a primary surface and a secondary surface, the primary surface having a common edge with and being generally perpendicular relative to the secondary surface.

17. The gaming system of claim 11, wherein at least one of the first movable panel and the second movable panel includes a liquid-crystal display (LCD).

18. A gaming machine comprising:

a cabinet having a primary surface and two sides, the primary surface facing a player position in front of the cabinet;

one or more display devices within the cabinet and configured to display a wagering game; and a top-box device having a top-box display facing the player position in front of the cabinet and having a front viewable surface defined by a pair of opposing top and bottom display edges and a pair of opposing side display edges extending between the top and bottom display edges, and a movable panel defined by a pair of opposing top and bottom panel edges and a pair of opposing side panel edges extending between the top and bottom panel edges, one of the side panel edges being rotatably attached to a rotational mount alongside and coincident with one of the side display edges of the top-box display, the movable panel having a secondary surface adjacent the rotational mount and a primary surface generally perpendicular to and sharing a common edge with the secondary surface, the secondary surface having a narrower width than the primary surface, the movable panel being fixed along the one of the side display edges and extending at least between the top and bottom display edges; wherein, in response to the movable panel being positioned in a closed position, the primary surface is generally parallel to the sides of the cabinet and the secondary surface is generally perpendicular to the sides of the cabinet, and wherein, in response to the movable panel being positioned in an open position, the primary surface is generally perpendicular to the sides of the cabinet and the secondary surface is generally parallel to the sides of the cabinet.

19. The gaming machine of claim 18, wherein the movable panel includes artwork illuminated via one or more controllable light-emitting diodes (LCD), the artwork being visible in the primary surface and the secondary surface from the player position.

20. The gaming machine of claim 18, wherein the movable panel includes at least one liquid-crystal display (LCD) for displaying artwork in at least one of the primary surface and the secondary surface.

* * * * *